US008464873B2

(12) United States Patent
Uchida

(10) Patent No.: US 8,464,873 B2
(45) Date of Patent: Jun. 18, 2013

(54) CONTAINER BOX AND SUBSTRATE SET

(75) Inventor: Tetsuo Uchida, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/296,432

(22) Filed: Nov. 15, 2011

(65) Prior Publication Data

US 2012/0118787 A1 May 17, 2012

(30) Foreign Application Priority Data

Nov. 15, 2010 (JP) ..... 2010-254544

(51) Int. Cl.
*B65D 85/00* (2006.01)

(52) U.S. Cl.
USPC ..... 206/722; 229/103; 229/160.1

(58) Field of Classification Search
USPC ..... 206/721, 722, 723, 701, 784, 525.1; 229/125.19, 103, 160.1, 939
See application file for complete search history.

(56) References Cited

U.S. PATENT DOCUMENTS 5,360,115 A 11/1994 Makino
5,484,063 A * 1/1996 Cuccio et al. ..... 206/722
5,803,267 A * 9/1998 Tu et al. ..... 206/576
6,193,069 B1 * 2/2001 Guenther et al. ..... 206/723
6,216,871 B1 * 4/2001 Bacques et al. ..... 206/497
7,733,666 B2 * 6/2010 Ichihara et al. ..... 361/797

FOREIGN PATENT DOCUMENTS

JP 06-001335 A 1/1994
JP 06-37982 Y2 10/1994
JP 2008-016333 A 1/2008

* cited by examiner

*Primary Examiner* — Jacob K Ackun
(74) *Attorney, Agent, or Firm* — Sughrue Mion, PLLC

(57) ABSTRACT

A container box for containing a first substrate mounted to a second substrate having a standing wall with a bottom edge includes top and bottom surfaces, first and second side surfaces, and first to third edges along which the bottom and first side surfaces, the bottom and second side surfaces, and the first and second side surfaces contact. If the top surface is opened, the first and second side surfaces are separable. A length of the third edge is substantially equal to a shortest length between the bottom edge and a contact line between the second substrate and the standing wall. The first edge is longer than an edge of the first substrate and a half length of an edge of the second substrate. The second edge is longer than another edge of the first substrate and a half length of another edge of the second substrate.

16 Claims, 11 Drawing Sheets

CONTAINER BOX AND SUBSTRATE SET

CROSS-REFERENCE TO RELATED APPLICATIONS

This application is based on and claims priority under 35 USC 119 from Japanese Patent Application No. 2010-254544 filed Nov. 15, 2010.

BACKGROUND (i) Technical Field

The present invention relates to a container box and a substrate set.

(ii) Related Art

An example of an image forming apparatus, such as a printer, includes a controller substrate to which a so-called option substrate for providing an additional function may be attached.

Such an option substrate is generally transported while being contained in a dedicated container box formed of, for example, corrugated board.

If a user attaches the option substrate to the controller substrate while the controller substrate is placed directly on the floor or the like, there is a possibility that the controller substrate cannot be placed in a stable position because of projections and recesses formed by components mounted on the controller substrate.

In such a case, workability in connecting a connector on the option substrate to a connector on the controller substrate may be reduced.

In addition, since the controller substrate is in an unstable position, a large force may be applied to a portion of the controller substrate. This may result in wire breakage in a wiring portion or damage of components, such as ICs and capacitors.

SUMMARY

According to an aspect of the invention, a container box for containing a first substrate which is mounted to a second substrate having a standing wall, the standing wall having a bottom edge being parallel to the second substrate and being in an opposite side of a surface of the second substrate to which the first substrate is mounted, includes a bottom surface, plural side surfaces that include a first side surface and a second side surface, a top surface, a first edge along which the bottom surface and the first side surface contact, a second edge along which the bottom surface and the second side surface contact, and a third edge along which the first side surface and the second side surface contact. If the top surface is opened, the first side surface and the second side surface are capable of being separated at the third edge. A length of the third edge is substantially equal to a shortest length between the bottom edge of the standing wall and a contact line between the second substrate and the standing wall. A length of the first edge is longer than a length of an edge of the first substrate and a half length of an edge of the second substrate. A length of the second edge is longer than a length of another edge of the first substrate and a half length of another edge of the second substrate.

BRIEF DESCRIPTION OF THE DRAWINGS

Exemplary embodiments of the present invention will be described in detail based on the following figures, wherein.

DETAILED DESCRIPTION

Figure 1:
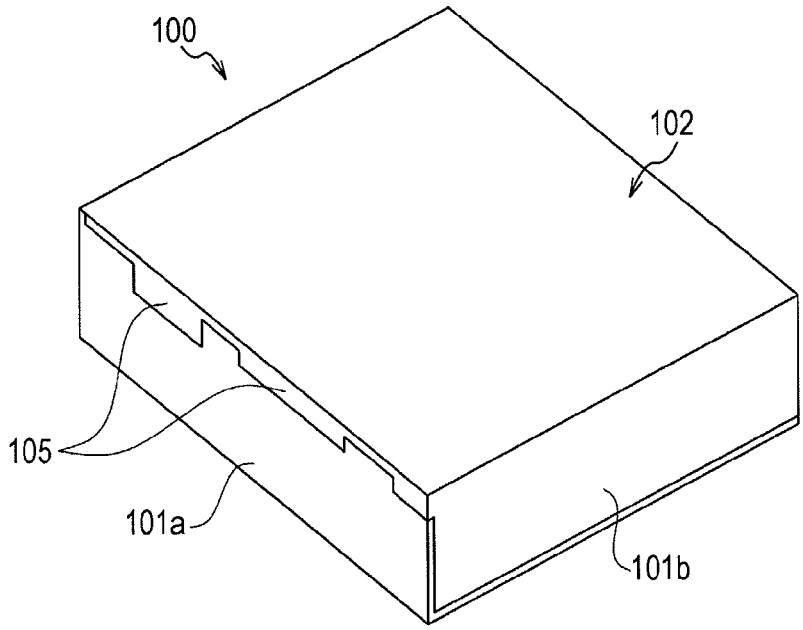
FIG. 1 is a diagram illustrating a step of a substrate attaching method according to a first exemplary embodiment.

Exemplary embodiments of the present invention will be described in detail below with reference to the accompanying drawings. In the drawings, the same components are denoted by the same reference numerals, and redundant explanations are omitted. The exemplary embodiments described herein are best modes for carrying out the present invention, and the present invention is not limited thereto.

Before explaining substrate attaching methods according to exemplary embodiments of the present invention, a comparative example will be described with reference to FIGS. 15A to 16B.

Here, it is assumed that an option substrate 200 for providing an additional function is to be attached to a controller substrate 800 in an image forming apparatus, such as a printer. In this case, if the controller substrate 800 is placed directly on the floor or the like, there is a possibility that the controller substrate 800 cannot be placed in a stable position because of projections and recesses formed by components mounted on the controller substrate 800. In such a case, workability in connecting a connector 201 on the option substrate 200 to a connector 803 on the controller substrate 800 may be reduced.

In addition, since the controller substrate 800 is in an unstable position, a large force may be applied to a portion of the controller substrate 800. This may result in wire breakage in a wiring portion or damage of components, such as ICs and capacitors.

Figure 15A:
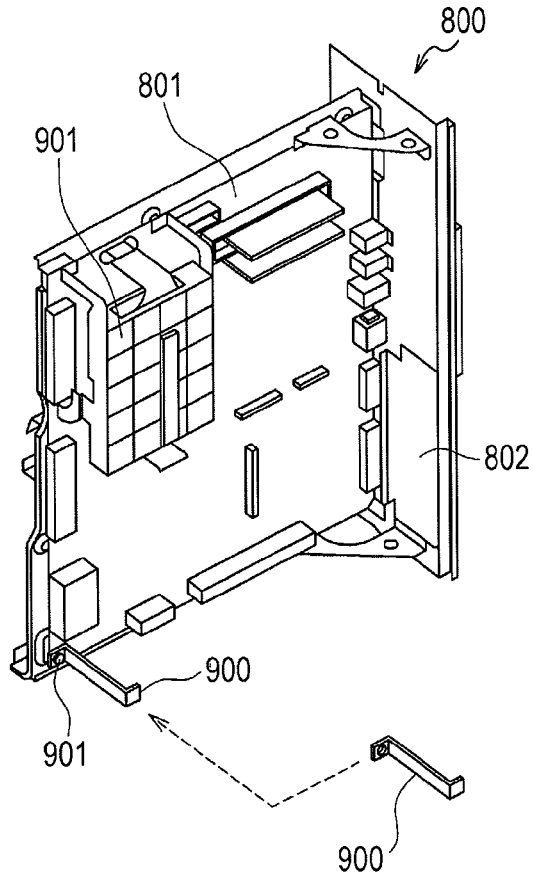
FIGS. 15A and 15B are diagrams illustrating steps of a substrate attaching method according to a comparative example.

Accordingly, in the comparative example, insertion holes 901 are formed at two corners of a substrate portion 801 of the controller substrate 800, and leg members 900 made of resin are attached to the controller substrate 800, as illustrated in FIG. 15A.

Figure 15B:
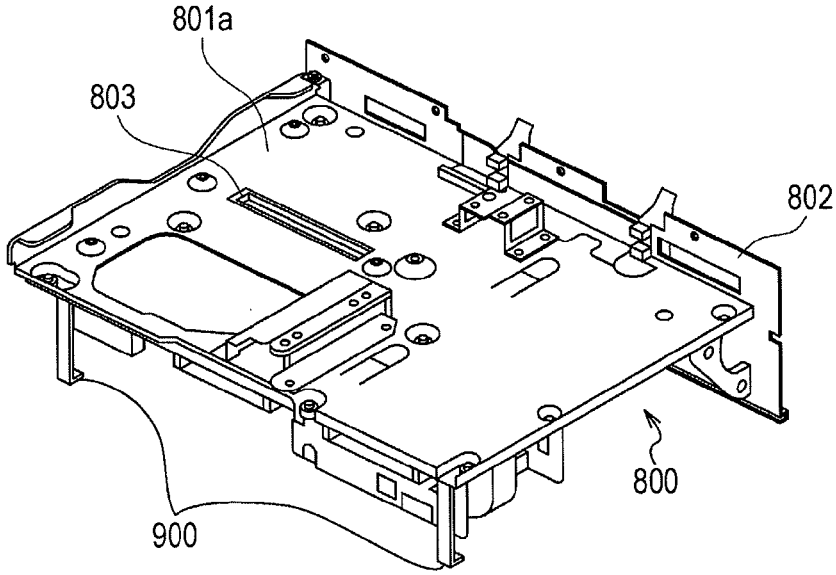

Thus, as illustrated in FIG. 15B, the controller substrate 800 may be supported in a horizontal orientation by the two leg members 900 and a standing portion (substrate chassis) 802 that stands so as to extend from the substrate portion 801.

Figure 16A:
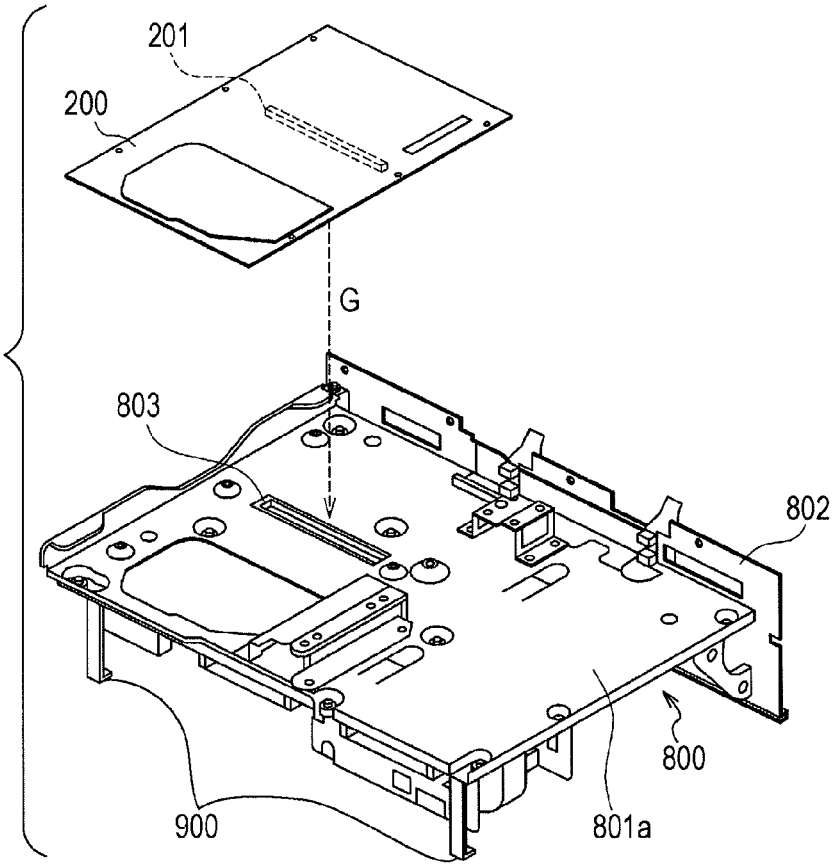
FIGS. 16A and 16B are diagrams illustrating the next steps of the substrate attaching method according to the comparative example.
Figure 16B:
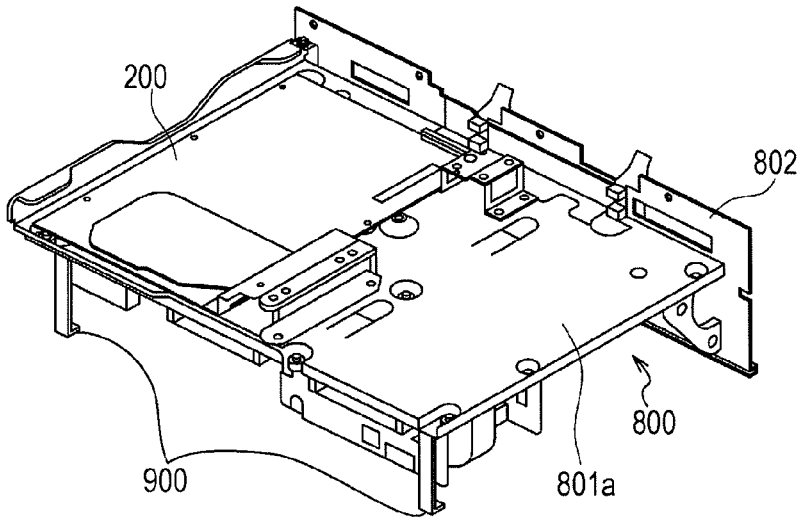

In this state, the connector 201 of the option substrate 200 is positioned with respect to the connector 803 of the controller substrate 800, as illustrated in FIG. 16A, and the option substrate 200 is pushed in the direction shown by arrow G. Accordingly, the connector 201 of the option substrate 200 is connected to the connector 803 of the controller substrate 800. Thus, the process of attaching the option substrate 200 to the controller substrate 800 is completed, as illustrated in FIG. 16B.

In the above-described comparative example, it is necessary to prepare the leg members 900 for each option substrate 200. Therefore, high costs are incurred.

In addition, the cumbersome task of attaching and detaching the leg members 900 is performed each time the option substrate 200 is attached to the controller substrate 800.

The present invention has been made as a result of an intensive study conducted by the inventor of the present invention to address the above-described problems.

Substrate attaching methods according to exemplary embodiments of the present invention will be described with reference to FIGS. 1 to 14.

First, a substrate attaching method according to a first exemplary embodiment will be described with reference to FIGS. 1 to 8.

Figure 2:
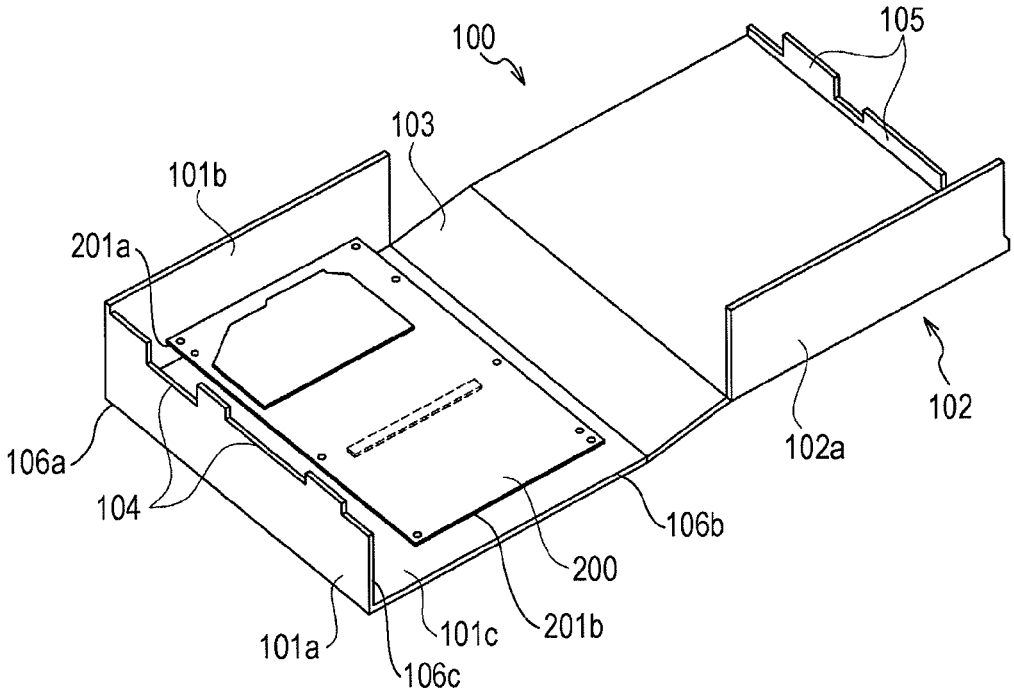
FIG. 2 is a diagram illustrating the next step of the substrate attaching method according to the first exemplary embodiment.

When an attachment process is started, first, a top cover portion 102 of a container box 100 (see FIG. 1) is opened, as illustrated in FIG. 2 (first step). The container box 100 is made of corrugated board, and contains the option substrate 200 to be attached (an example of a first substrate).

In the opened state, the container box 100 includes a bottom portion 101*c*, standing portions 101*a* and 101*b* that stand along two sides of the bottom portion 101*c*, a side wall portion 103, the top cover portion 102, and a standing portion 102*a* that stands along one side of the top cover portion 102. The standing portions 101*a* remains contacting the bottom portion 101*c* at an edge 106*a* and is separated from the standing portion 102*a* at an edge 106*c*. The standing portion 102*a* remains contacting a top cover portion 102 and is separated from the bottom portion 101*c* at an edge 106*b*. The standing portions 101*b* remains contacting the bottom portion 101*c* and the standing portions 101*a*.

Cut portions 104 having shapes corresponding to the shapes of various connectors 304 and the like of a controller substrate 300, which will be described below, are formed in the standing portion 101*a* at the top edge thereof.

Projections 105 that fit into the cut portions 104 when the top cover portion 102 is closed is provided on the top cover portion 102 at one side thereof.

Figure 3:
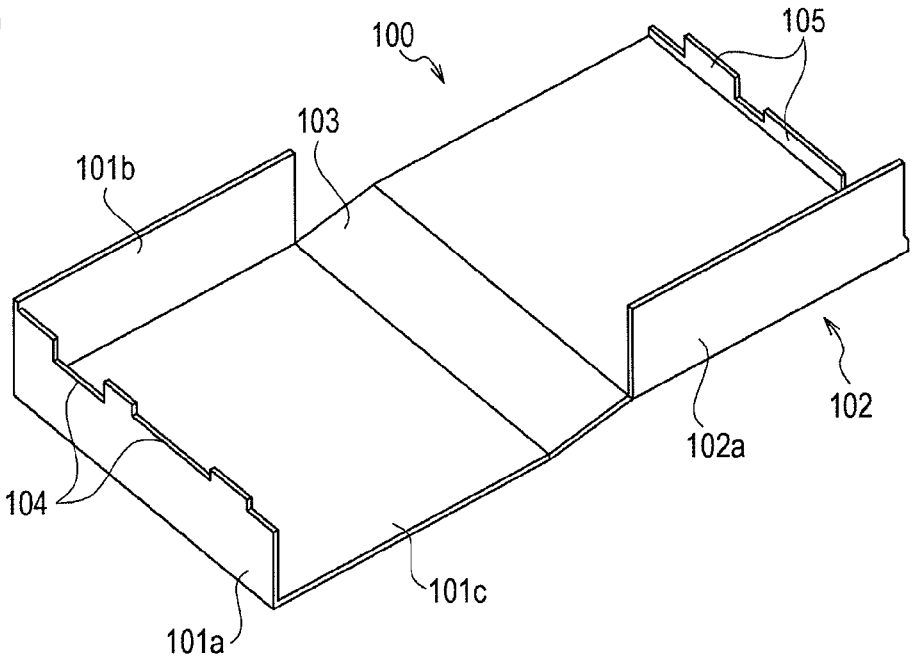
FIG. 3 is a diagram illustrating the next step of the substrate attaching method according to the first exemplary embodiment.

Next, the option substrate 200 placed on the bottom portion 101*c* of the container box 100 is taken out (see FIGS. 2 and 3). A length of the edge 106*a* is longer than a length of an edge 201*a* of the option substrate 200. A length of an edge 106*b* is longer than a length of an edge 201*b* of the option substrate 200.

Figure 4:
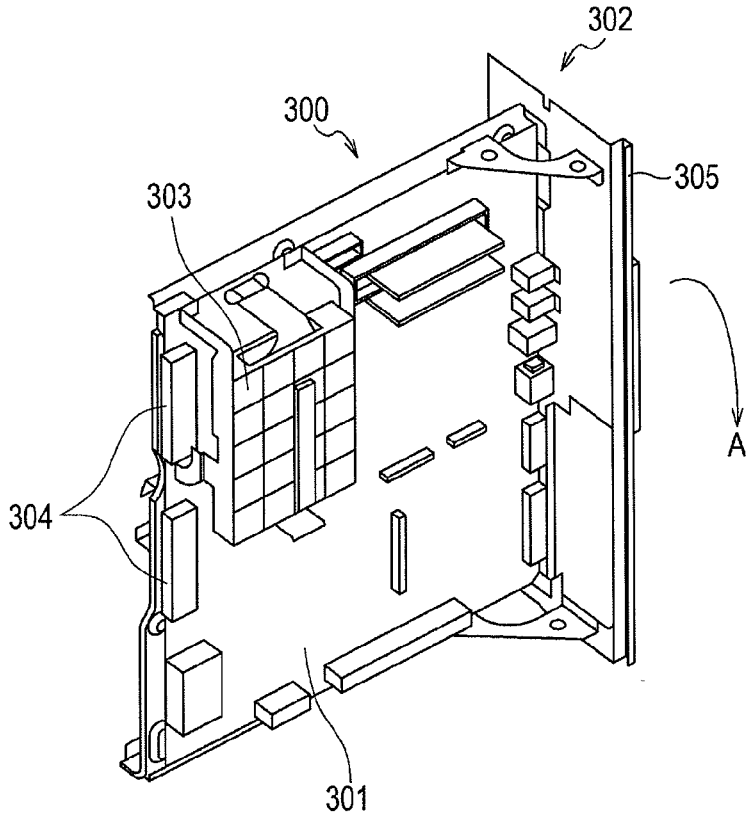
FIG. 4 is a diagram illustrating the next step of the substrate attaching method according to the first exemplary embodiment.
Figure 5:
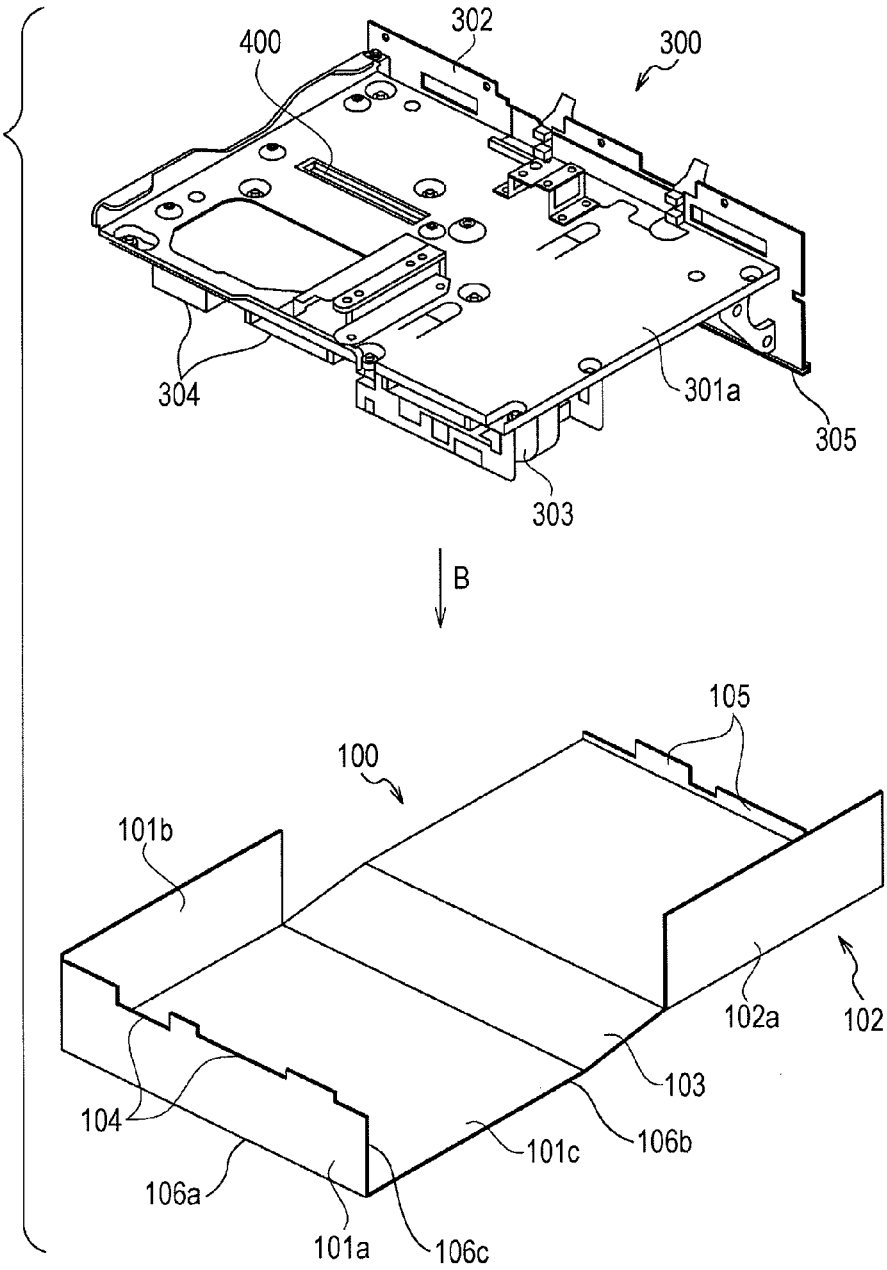
FIG. 5 is a diagram illustrating the next step of the substrate attaching method according to the first exemplary embodiment.

Then, as illustrated in FIGS. 4 and 5, the controller substrate 300 (an example of a second substrate) of, for example, a printer or the like to which the option substrate 200 is to be added is prepared. The orientation of the controller substrate 300 is changed, for example, in the direction shown by arrow A so that a connector 400, which serves as a connecting portion that provides connection to the option substrate 200, faces upward (second step).

Although not particularly limited, a hard disk device 303, various connectors 304, etc., may be provided on a substrate portion 301 of the controller substrate 300, as illustrated in FIG. 4.

A standing wall (substrate chassis) 302 that stands on the substrate portion 301 is provided at one side of the substrate portion 301. The bottom edge 305 of the standing wall 302 is parallel to the controller substrate 300 and is in an opposite side of a surface of the controller substrate 300 to which the option substrate 200 is mounted when the option substrate 200 is connected to the controller substrate 300 as described below.

Referring to FIGS. 3 and 5, the container box 100 in the opened state has no standing portion at a position where the standing wall 302 is positioned when the controller substrate 300 is placed on the container box 100 as described below.

Figure 6:
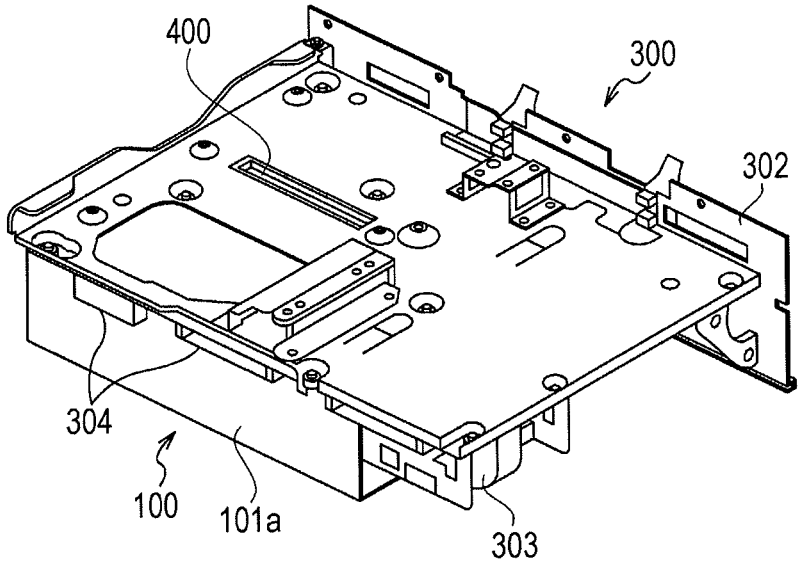
FIG. 6 is a diagram illustrating the next step of the substrate attaching method according to the first exemplary embodiment.

Next, as illustrated in FIG. 5, the controller substrate 300, whose orientation has been changed in the second step, is lowered in the direction shown by arrow B so that edge portions of the controller substrate 300 are placed on the standing portions 101*a*, 101*b*, and 102*a* of the container box 100 in the opened state (third step). Accordingly, the state illustrated in FIG. 6 is established.

Figure 7:
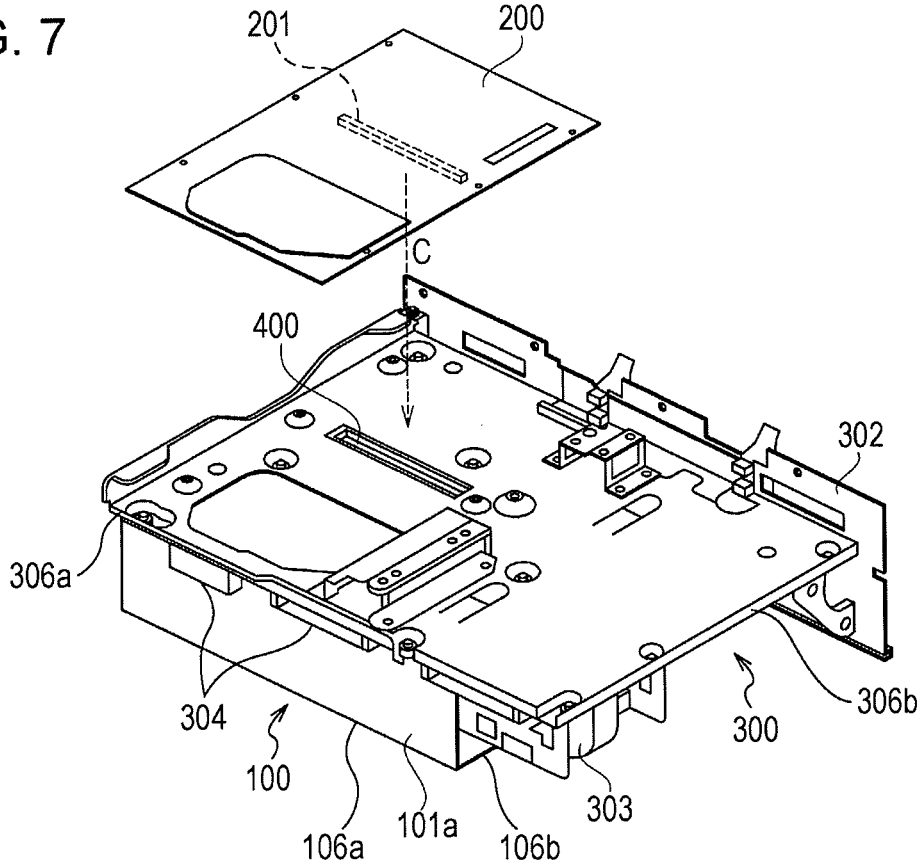
FIG. 7 is a diagram illustrating the next step of the substrate attaching method according to the first exemplary embodiment.

Next, as illustrated in FIG. 7, the connector 201 of the option substrate 200 is positioned with respect to the connector 400 of the controller substrate 300 in the state in which the edge portions of the controller substrate 300 are placed on the standing portions 101*a*, 101*b*, and 102*a* (fourth step).

A length of the edge 106*c* is substantially equal to a shortest length between the bottom edge 305 of the standing wall 302 and a contact line between the controller substrate 300 and the standing wall 302.

Then, in the state in which the connectors 201 and 400 are positioned with respect to each other, the option substrate 200 is pushed against the controller substrate 300 in the direction shown by arrow C, so that the connectors 201 and 400 are connected to each other (fifth step). A length of the edge 106*a* is longer than a half length of an edge 306*a* of the controller substrate 300. A length of an edge 106*b* is longer than a half length of an edge 306*b* of the controller substrate 300.

Figure 8:
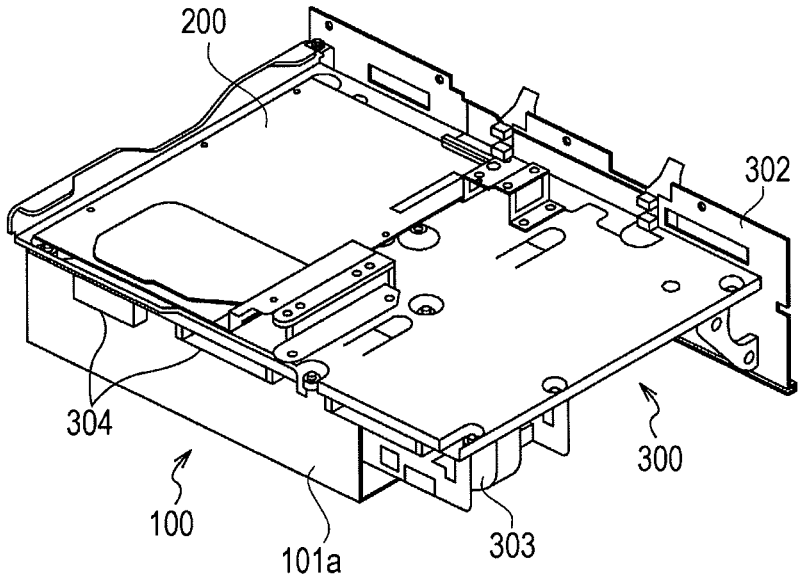
FIG. 8 is a diagram illustrating the next step of the substrate attaching method according to the first exemplary embodiment.

Thus, the process of attaching the option substrate 200 to the controller substrate 300 is completed, as illustrated in FIG. 8.

According to the substrate attaching method of the present exemplary embodiment, the container box in the opened state is utilized, so that convenience is improved and the cost is reduced.

After the controller substrate 300 is removed, the container box 100 in the opened state is closed again and reused.

More specifically, when, for example, the option substrate 200 is attached to the controller substrate 300 so as to replace an old option substrate that has been defective, the old option substrate may be placed in the container box 100 and sent back.

A modification of the first exemplary embodiment will be described with reference to FIGS. 9A to 9C.

Figure 9A:
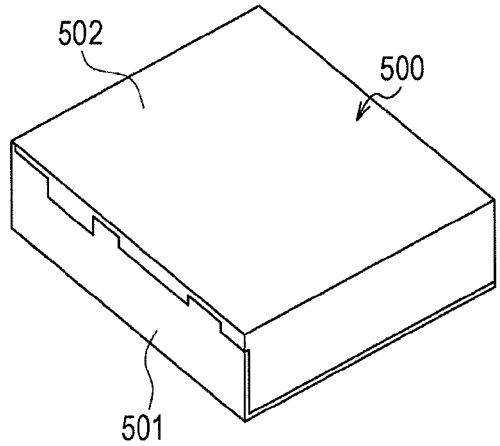
FIGS. 9A to 9C are diagrams illustrating a modification of the substrate attaching method according to the first exemplary embodiment.

As illustrated in FIG. 9A, the appearance of a container box 500 according to the modification is similar to that of the container box 100 illustrated in FIG. 1.

Figure 9B:
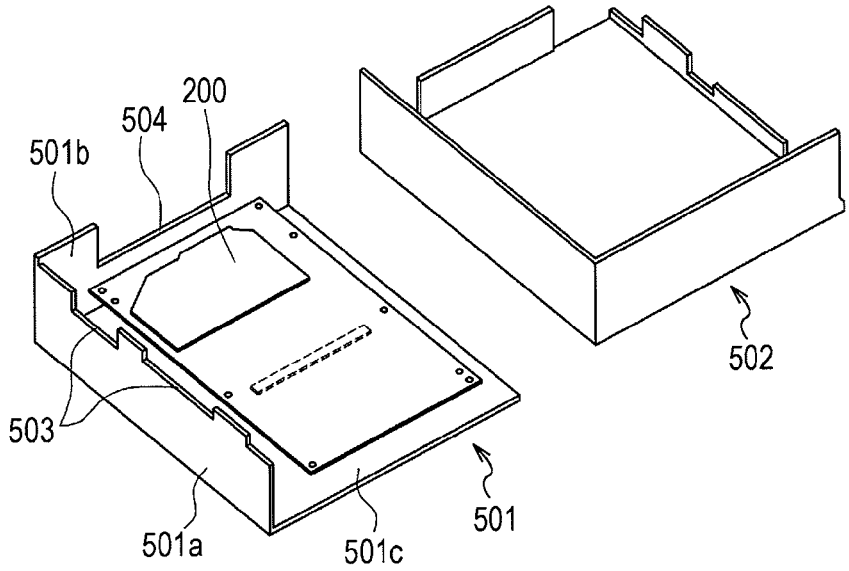

The modification differs from the first exemplary embodiment in that the container box 500 may be divided into a lower part 501 and an upper part 502 (see FIG. 9B).

Figure 9C:
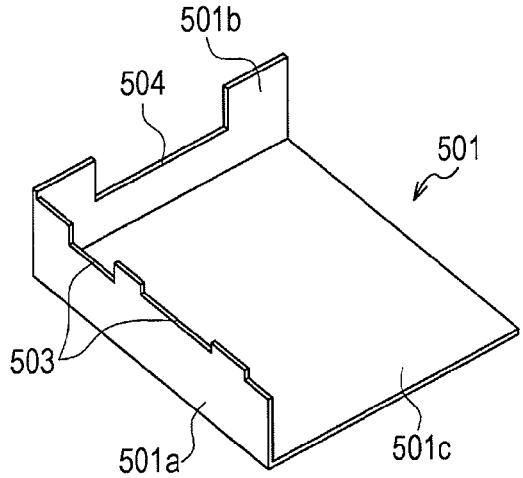

As illustrated in FIG. 9C, the lower part 501 includes a bottom portion 501*c* and standing portions 501*a* and 501*b* that stand on the bottom portion 501*c*.

Cut portions 503 and 504 having shapes corresponding to the shape of the controller substrate 300 are formed in the standing portions 501*a* and 501*b*.

Similar to the steps illustrated in FIGS. 5 to 8, the option substrate 200 is attached to the controller substrate 300 while the controller substrate 300 is placed on the lower part 501 of the container box 500.

Accordingly, a part of the container box in the opened state is utilized so that convenience is improved and the cost is reduced.

A substrate attaching method according to a second exemplary embodiment will now be described with reference to FIGS. 10 to 14.

Figure 10:
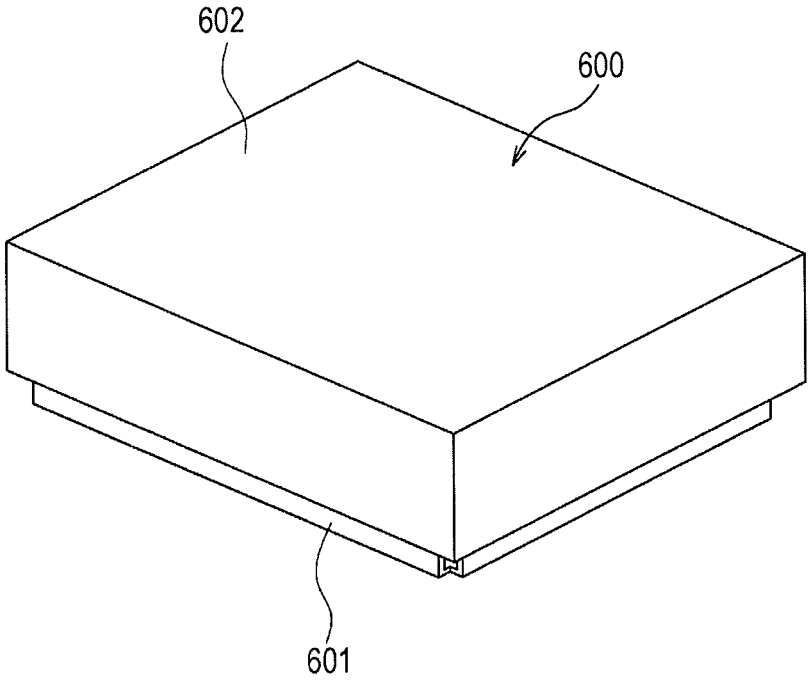
FIG. 10 is a diagram illustrating a step of a substrate attaching method according to a second exemplary embodiment.
Figure 11:
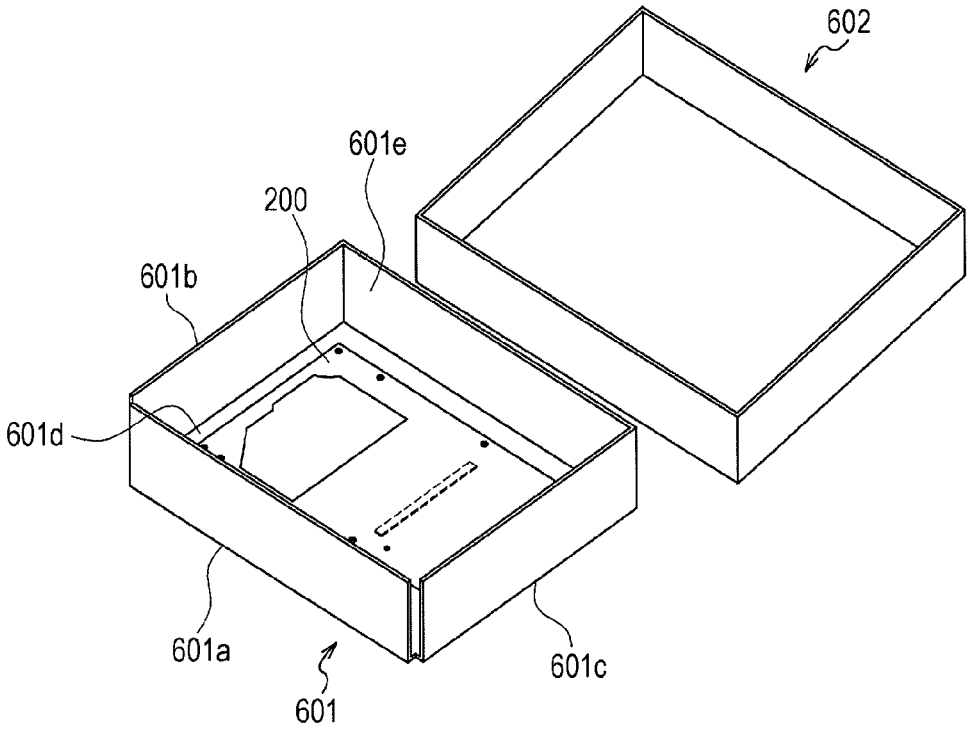
FIG. 11 is a diagram illustrating the next step of the substrate attaching method according to the second exemplary embodiment.

When an attachment process is started, first, a container box 600 is opened by removing an upper box body 602 (first step, see FIGS. 10 and 11). The container box 600 contains the option substrate 200 to be added, and includes a lower box body 601 and the upper box body 602.

Next, the option substrate 200 (an example of a first substrate) placed on a bottom portion 601*d* of the lower box body 601 is taken out.

Figure 12:
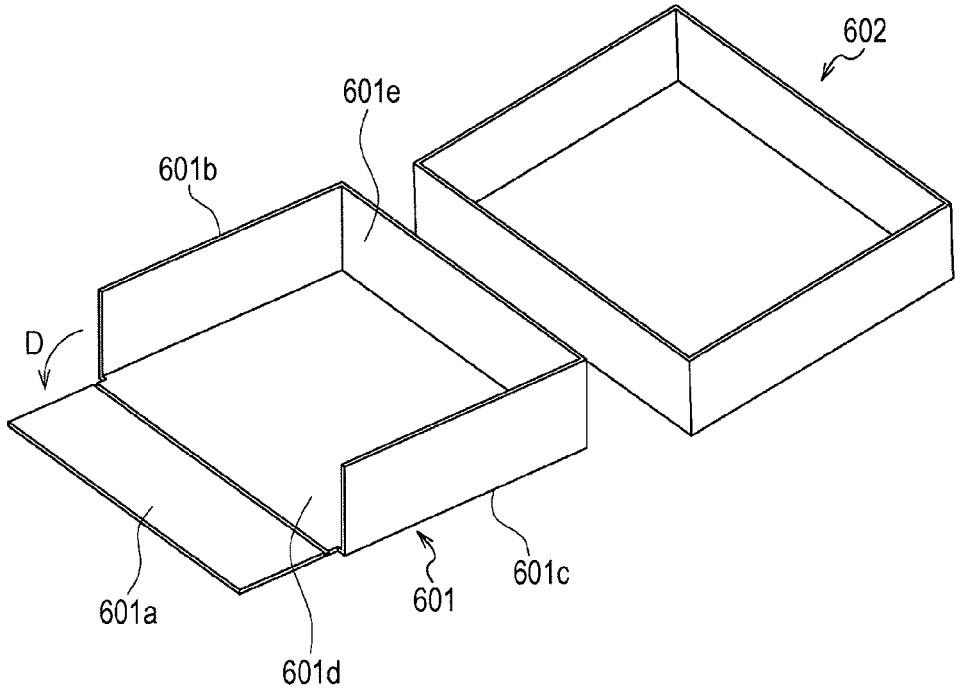
FIG. 12 is a diagram illustrating the next step of the substrate attaching method according to the second exemplary embodiment.

As illustrated in FIG. 11, the lower box body 601 includes side wall portions 601*a*, 601*b*, 601*c*, and 601*e*. The side wall portion 601*a* may be opened in the direction shown by arrow D, as illustrated in FIG. 12.

Then, as illustrated in FIG. 4, the controller substrate 300 (an example of a second substrate) of, for example, a printer or the like to which the option substrate 200 is to be added is prepared. The orientation of the controller substrate 300 is changed, for example, in the direction shown by arrow A so that the connector 400, which serves as a connecting portion that provides connection to the option substrate 200, faces upward (second step).

Figure 14:
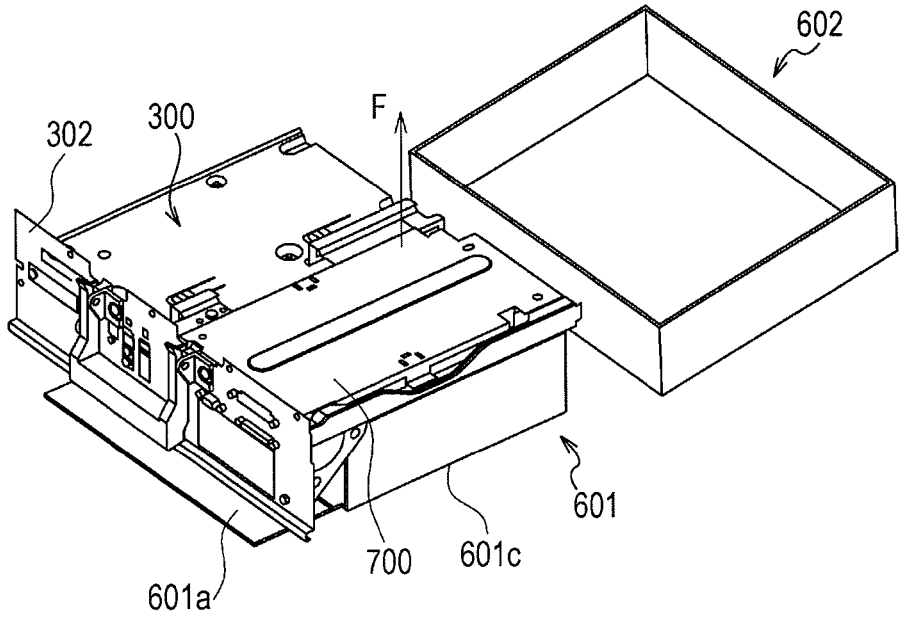
FIG. 14 is a diagram illustrating the next step of the substrate attaching method according to the second exemplary embodiment.

Next, as illustrated in FIG. 14, edge portions of the controller substrate 300, whose orientation has been changed in the second step, are placed on the side wall portions 601*b*, 601*c*, and 601*e* of the lower box body 601 (third step).

Figure 13:
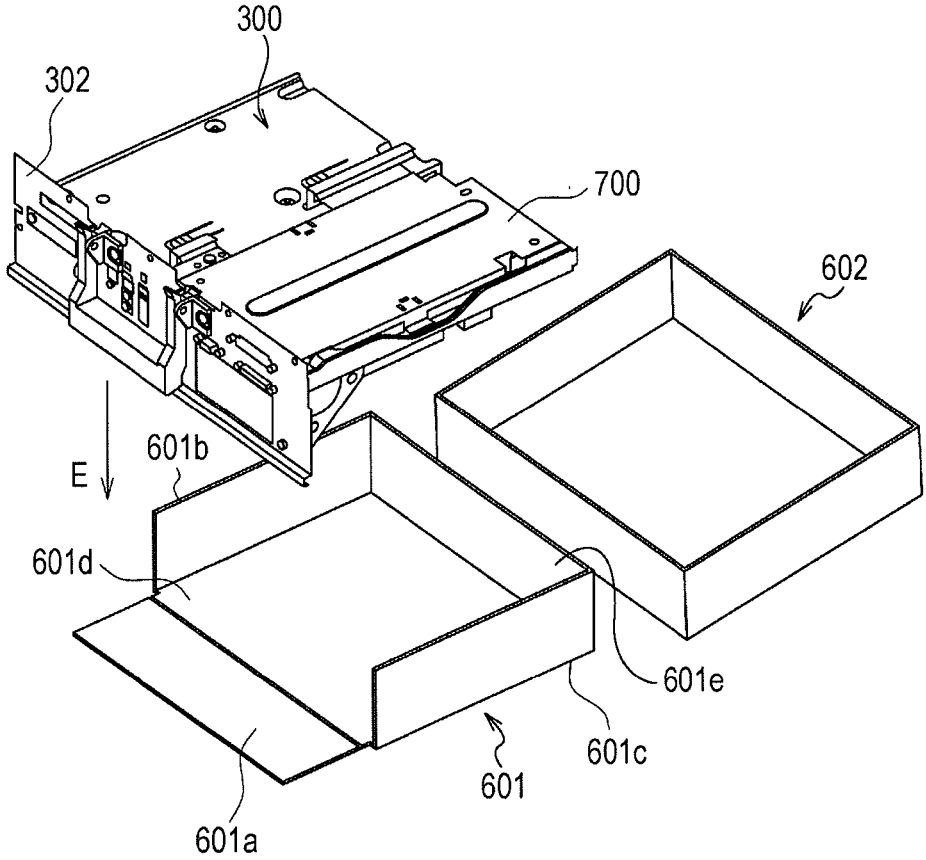
FIG. 13 is a diagram illustrating the next step of the substrate attaching method according to the second exemplary embodiment.

In the example illustrated in FIGS. 13 and 14, the controller substrate 300 has an old option substrate 700 attached thereto.

Therefore, before the option substrate 200 is attached, the option substrate 700 is pulled in the direction shown by arrow F and detached from the controller substrate 300.

Next, the connector 201 of the option substrate 200 is positioned with respect to the connector 400 of the controller substrate 300 in the state in which the edge portions of the controller substrate 300 are placed on the side wall portions 601*b*, 601*c*, and 601*e* (fourth step, see FIG. 7).

Then, in the state in which the connectors 201 and 400 are positioned with respect to each other, the option substrate 200 is pushed against the controller substrate 300, so that the connectors 201 and 400 are connected to each other (fifth step).

According to the substrate attaching method of the present exemplary embodiment, a part of the container box 600 is utilized, so that convenience is improved and the cost is reduced.

The container box 600 is used to, for example, pack the option substrate 700 when the option substrate 700 is sent back.

Although the controller substrate 300 is placed on the lower box body 601 in the above-described exemplary embodiment, the controller substrate 300 may instead be placed on the upper box body 602.

The substrate attaching method according to the exemplary embodiments of the present invention may be applied to controller substrates or the like included in a printer or a multifunction machine.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A container box, a first substrate, and a second substrate, the container box carries the first substrate which is mountable on a first surface of the second substrate having a standing wall, the container box comprising:

a bottom surface;

a plurality of side surfaces that include a first side surface and a second side surface, the first side surface and the second side surface are separable from each other, wherein the container box is capable of supporting the second substrate when mounting the first substrate on the second substrate, and the first side surface has a height such that the container box supports the second substrate horizontally with the standing wall.

2. The container box according to claim 1, wherein the first side surface has a cut portion having a shape that corresponds to the shape of an opposite surface of the surface of the second substrate to which the first substrate is mounted, and the first side surface is cut at the cut portion.

3. The container box according to claim 1, wherein the second side surface and the bottom surface are capable of being separated.

4. The container box according to claim 1, wherein the plurality of side surfaces include a third side surface, and the third side surface remains contacting the bottom surface and the first side surface.

5. A container box comprising:

a first substrate which is mounted to a second substrate having a standing wall, the standing wall having a bottom edge being parallel to the second substrate and being in an opposite side of a surface of the second substrate to which the first substrate is mounted;

a bottom surface;

a plurality of side surfaces that include a first side surface and a second side surface;

a top surface;

a first edge along which the bottom surface and the first side surface contact;

a second edge along which the bottom surface and the second side surface contact; and a third edge along which the first side surface and the second side surface contact, wherein if the top surface is opened, the first side surface and the second side surface are capable of being separated at the third edge, wherein a length of the third edge is substantially equal to a shortest length between the bottom edge of the standing wall and a contact line between the second substrate and the standing wall, wherein a length of the first edge is longer than a length of an edge of the first substrate and a half length of an edge of the second substrate, and wherein a length of the second edge is longer than a length of another edge of the first substrate and a half length of another edge of the second substrate.

6. The container box according to claim 5, wherein the first side surface has a cut portion having a shape that corresponds to the shape of an opposite surface of the surface of the second substrate to which the first substrate is mounted, and wherein if the top surface is opened, the first side surface is cut at the cut portion.

7. The container box according to claim 5, wherein if the top surface is opened, the second side surface and the bottom surface are capable of being separated at the second edge.

8. The container box according to claim 7, wherein if the top surface is opened, the second side surface remains contacting the top surface.

9. The container box according to claim 5, wherein the plurality of side surfaces include a third side surface, and if the top surface is opened, the third side surface remains contacting the bottom surface and the first side surface.

10. The container box according to claim 5, wherein if the top surface is opened, the top surface is separated from the first side surface and the second side surface.

11. A substrate set comprising:

a first substrate;

a second substrate to which the first substrate is mounted, the second substrate having a standing wall, the standing wall having a bottom edge being parallel to the second substrate and being in an opposite side of a surface of the second substrate to which the first substrate is mounted; and a container box that contains the first substrate, the container box including a bottom surface, a plurality of side surfaces that include a first side surface and a second side surface, a top surface, a first edge along which the bottom surface and the first side surface contact, a second edge along which the bottom surface and the second side surface contact, and a third edge along which the first side surface and the second side surface contact, wherein if the top surface is opened, the first side surface and the second side surface are capable of being separated at the third edge, wherein a length of the third edge is substantially equal to a shortest length between the bottom edge of the standing wall and a contact line between the second substrate and the standing wall, wherein a length of the first edge is longer than a length of an edge of the first substrate and a half length of an edge of the second substrate, and wherein a length of the second edge is longer than a length of another edge of the first substrate and a half length of another edge of the second substrate.

12. The substrate set according to claim 11, wherein the first side surface has a cut portion having a shape that corresponds to the shape of an opposite surface of the surface of the second substrate to which the first substrate is mounted, and wherein if the top surface is opened, the first side surface is cut at the cut portion.

13. The substrate set according to claim 11, wherein if the top surface is opened, the second side surface and the bottom surface are capable of being separated at the second edge.

14. The substrate set according to claim 11, wherein if the top surface is opened, the second side surface remains contacting the top surface.

15. The substrate set according to claim 11, wherein the plurality of side surfaces include a third side surface, and if the top surface is opened, the third side surface remains contacting the bottom surface and the first side surface.

16. The substrate set according to claim 11, wherein if the top surface is opened, the top surface is separated from the first side surface and the second side surface.

* * * * *